US008876432B2

(12) United States Patent
Chen et al.

(10) Patent No.: US 8,876,432 B2
(45) Date of Patent: Nov. 4, 2014

(54) METHOD FOR MANUFACTURING GEOLOGICAL GRADATION FEATURING DISASTER PREVENTION AND ECOLOGIC FUNCTION

(71) Applicants: Jui-Wen Chen, New Taipei (TW); Ting-Hao Chen, New Taipei (TW)

(72) Inventors: Jui-Wen Chen, New Taipei (TW); Ting-Hao Chen, New Taipei (TW)

( * ) Notice: Subject to any disclaimer, the term of this patent is extended or adjusted under 35 U.S.C. 154(b) by 0 days.

(21) Appl. No.: 14/157,531

(22) Filed: Jan. 17, 2014

(65) Prior Publication Data

US 2014/0140765 A1 May 22, 2014

Related U.S. Application Data

(63) Continuation-in-part of application No. 12/946,812, filed on Nov. 15, 2010, now abandoned.

(30) Foreign Application Priority Data

Sep. 9, 2010 (TW) ..... 99130439 A

(51) Int. Cl.

| | |
|---|---|
| ***E01C 3/00*** | (2006.01) |
| ***E02D 17/20*** | (2006.01) |
| ***E01C 3/06*** | (2006.01) |
| ***E01C 7/14*** | (2006.01) |
| ***E01C 9/00*** | (2006.01) |
| ***E01C 11/22*** | (2006.01) |
| ***E01C 19/50*** | (2006.01) |

(52) U.S. Cl.

CPC ..... *E01C 3/003* (2013.01); *E02D 17/20* (2013.01); *E01C 3/06* (2013.01); *E01C 7/14* (2013.01); *E01C 9/001* (2013.01); *E01C 11/226* (2013.01); *E01C 19/508* (2013.01); *E01C 2201/20* (2013.01)

USPC ..... 405/128.1; 405/302.4; 404/31; 428/35.7

(58) Field of Classification Search

USPC ..... 404/17, 31; 428/35.7; 405/302.4, 128.1

See application file for complete search history.

(56) References Cited

U.S. PATENT DOCUMENTS

| | | | | | |
|---|---|---|---|---|---|
| 4,411,555 | A * | 10/1983 | Minvielle et al. | ..... | 405/50 |
| 5,100,258 | A * | 3/1992 | VanWagoner | ..... | 405/45 |
| 5,906,454 | A * | 5/1999 | Medico et al. | ..... | 404/32 |
| 6,102,613 | A * | 8/2000 | Medico et al. | ..... | 404/17 |
| 2003/0091389 | A1 * | 5/2003 | Zentner | ..... | 404/17 |
| 2006/0285927 | A1 * | 12/2006 | Hisgrove et al. | ..... | 405/53 |
| 2009/0279953 | A1 * | 11/2009 | Allard et al. | ..... | 405/39 |

* cited by examiner

*Primary Examiner* — Tara M. Pinnock
(74) *Attorney, Agent, or Firm* — Leong C. Lei

(57) ABSTRACT

Provided is a method for manufacturing geological gradation layer featuring disaster prevention and ecologic function, which uses on-site earth or gradation materials commonly adopted in road construction, including aggregates, soils, gravels, or a mixture of water permeable concrete, and most importantly, added with uniquely arranged hollow bodies, all constituents being mixed and laid on soil stratum, and subjected to ramming, to form an ecological gradation layer. The ecological gradation layer provides an effect of supporting and also provides the functions of water storage, water preservation, and improving earth, whereby earth microorganisms and earth protozoa may establish a beneficial survival environment in earth, making the gradation layer exhibiting the characteristics of high water content and prompting breeding of microorganisms. When the atmosphere gets hot, water is released from the soil as vapor to alleviate the heat island effect and when rainwater precipitates, the rainwater can be stored for use in draughts.

13 Claims, 6 Drawing Sheets

METHOD FOR MANUFACTURING GEOLOGICAL GRADATION FEATURING DISASTER PREVENTION AND ECOLOGIC FUNCTION

CROSS-REFERENCE TO RELATED APPLICATION

This is a continuation-in-part of co-pending U.S. patent application Ser. No. 12/946,812 filed on Nov. 15, 2010 and owned by the present applicant.

(a) TECHNICAL FIELD OF THE INVENTION

The present invention generally relates to a method for manufacturing geologic gradation featuring disaster prevention and ecologic function, and more particularly to the formation of an underground ecologic gradation layer in or under surface paving of a road, a yard, or a vacant land, whereby when rainwater falling on the ground surface above the gradation layer permeates downward, the rainwater can be effectively and efficiently conducted into and preserved in the gradation layer for storing and preserving water in a short period, reducing the risk of flooding and providing an excellent propagation environment for microbial strains and protozoa inhabiting in earth, thereby helping maintaining soil wet and thus realizing regulation of temperature and humidity of the surroundings and improving quality of earth.

(b) DESCRIPTION OF THE PRIOR ART

As the soil has the function of absorbing water, and can vaporize humidity when contacting the atmosphere in a dry or hot environment to generate a heat exchange effect with the atmosphere, and may automatically regulate the humidity so as to avoid the occurrence of heat island effect.

For conventional techniques of underground gradation, it is common to use engineering gradation materials for road construction or the on-site earth, including aggregates, soils, or gravels, or a mixture of water permeable concrete for filling. Although this allows for permeation of rainwater therethrough and the gradation layer serves as a support for the upper-side paving, yet in case of extremely heavy precipitation on the ground surface of such a conventional gradation structure, the conventional gradation layer is not capable of quickly draining the rainwater, leading to significant accumulation of rainwater on the ground surface and thus causing flood disasters.

Formation of an ecologic gradation layer that allows for effective water permeation and water preservation is of vital importance. This is because proper water preservation will help improving earth ecologic environment and this creates a beneficial survival environment for microorganisms and earth protozoa inhabiting in earth. The microorganisms inhabiting in earth generally include bacteria (eubacteria and archaea), fungi (filamentous fungi and yeasts), and algae. The earth protozoa include for example amoeba and ciliates. There are a huge number of ciliates existing in earth, and they make a great contribution for decomposition of organic substances. Insects, including ants, centipedes, aphids, and mites, help moving soils or digests residual body portions of organisms and thus providing organic substances. Earthworms may help formation of soil pellets, which are good for air ventilation and water draining. Nematodes help digesting organic matters or other small creatures. There are also vertebrates inhabiting in earth, such as mice, which dig and loosen soil, and provide excrements for fertilizing earth. They are also a member of an underground food chain.

Earth microorganisms play an important role in keeping quality of earth, and also cast significant influence for the environment of the Earth. The existence of earth organisms is a vital factor for change and quality of earth environment.

In view of the above discussed issue, the present invention aims to provide a method for manufacturing geological gradation layer featuring disaster prevention and ecologic function, which converts an underground gradation layer into an ecological gradation layer to activate organic substances contained in soil and improve global warming problem.

SUMMARY OF THE INVENTION

Thus, an objective of the present invention is to provide a method for manufacturing geological gradation layer featuring disaster prevention and ecologic function, which allows rainwater permeating downward from surface paving to be efficiently collected and preserved, in order to reduce the risk of flood disasters and to make replenishment for underground water resources that help supplying water in a draughty period.

Another objective of the present invention is to provide a method for manufacturing geological gradation layer featuring disaster prevention and ecologic function, which upgrades an underground gradation layer into an ecological gradation layer, which ensures high water content so that when the outside temperature gets high, water contained in the gradation layer is converted into vapor to be released to the atmosphere in order to regulate surrounding temperature and humidity and thus eliminate or alleviate heat island effect and improve the global warming problem.

A further objective of the present invention is to provide a method for manufacturing geological gradation layer featuring disaster prevention and ecologic function, which allows the underground soil to provide an excellent inhabiting environment for a large number of microorganisms and earth protozoa, whereby with the microorganisms and the protozoa being effectively cultured and an excellent propagation environment being formed, the microorganisms and protozoa inhabiting in earth may help decomposing organic substances, promoting nitrification, performing de-nitrification, activating soil, and improving earth ecologic environment.

To achieve the above objectives, the present invention provides a for manufacturing geological gradation layer featuring disaster prevention and ecologic function, which uses on-site earth or engineering gradation materials commonly adopted in road construction, including aggregates, soils, gravels, or a mixture of water permeable concrete, and most importantly, added with uniquely arranged hollow bodies to form an ecological gradation layer. The ecological gradation layer provides an effect of supporting ground surface and also provides the functions of water storage, water preservation, and improving earth, whereby earth microorganisms and earth protozoa may establish a beneficial survival environment in earth, making the gradation layer exhibiting the characteristics of high water content and prompting breeding of microorganisms. When the temperature of the atmosphere gets high, water contained in soil may be released as vapor to alleviate the heat island effect and when rainwater precipitates, the rainwater can be collected and stored for use in draughts, thereby reducing the risk of flooding.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
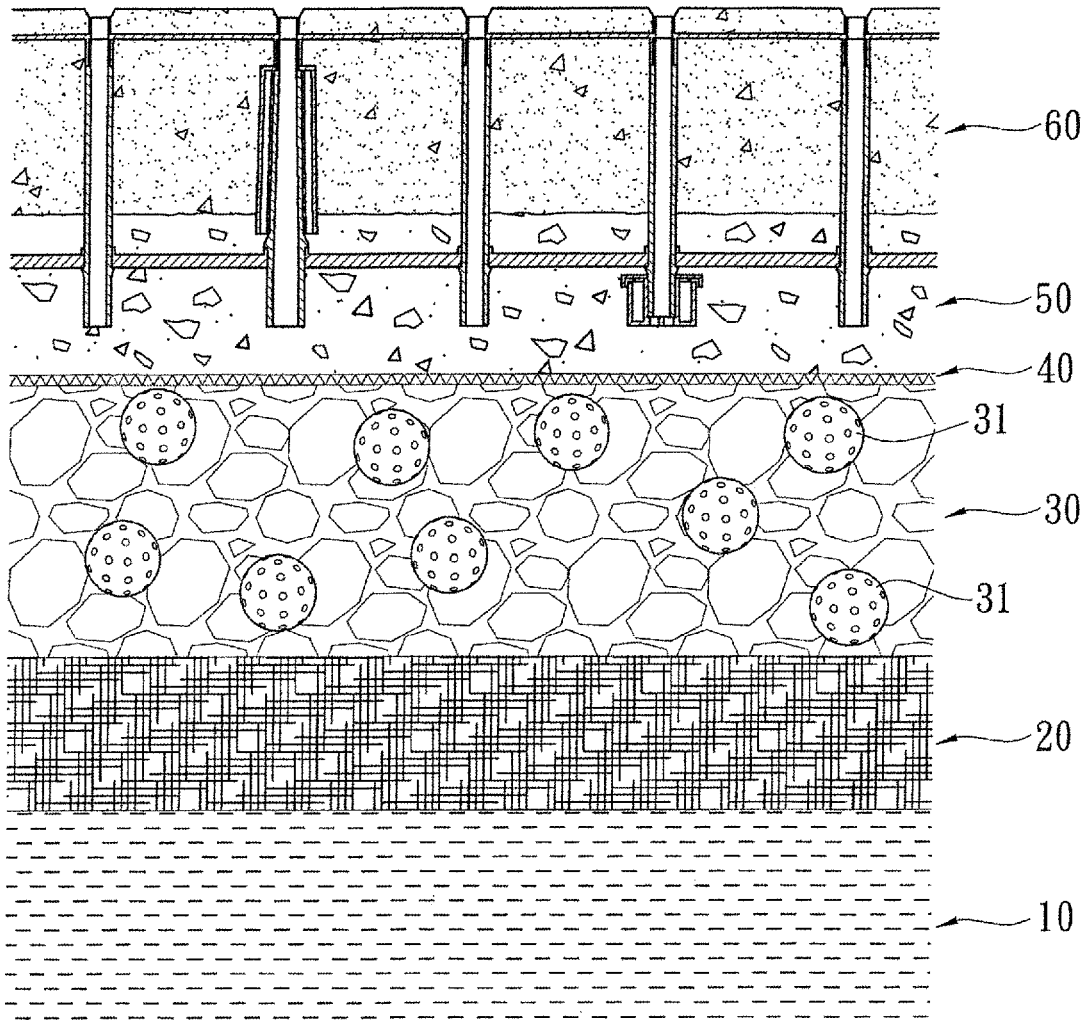
FIG. 1 is a schematic view showing an artificial geological layer of gradation constructed in accordance with the present invention.

Referring to FIG. 1, the present invention provides a method for geological gradation layer featuring disaster prevention and ecologic function. The geologic structure according to the embodiment illustrated in FIG. 1 comprises a water stratum 10, an underground soil stratum 20, a gradation layer 30, an interfacing layer 40, a water drain layer 50, and surface paving 60. The gradation layer 30 may use on-site earth or gradation materials commonly used for road construction, including aggregates, soils, gravels, a mixture of water-permeable concrete, and additionally and of importance, comprising unique hollow bodies 31. All the constituent components are mixed and laid on the bottom, and then subjected to pressurization for ramming.

Figure 2:
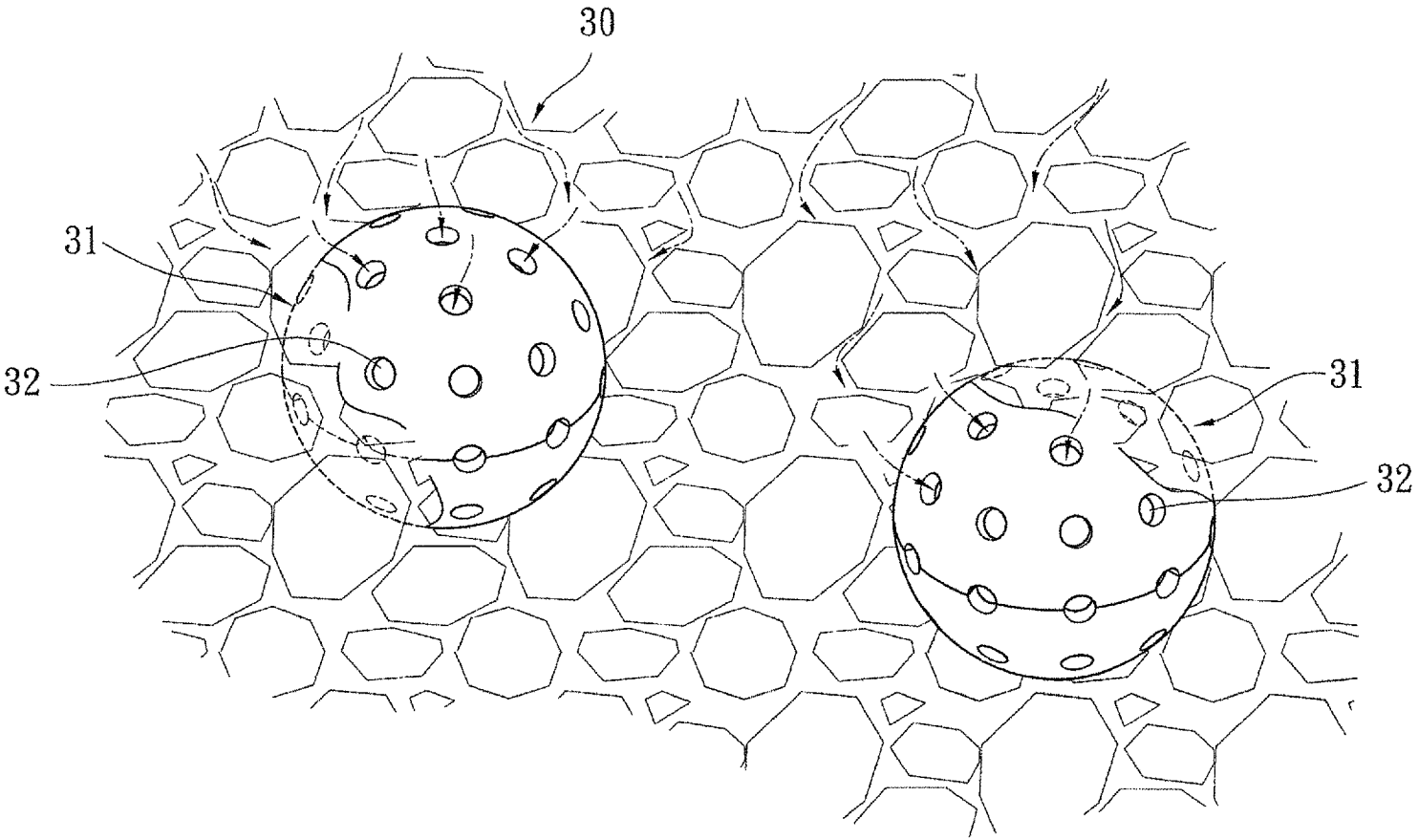
FIG. 2 is a schematic view showing a gradation layer containing hollow bodies mixed therein according to the present invention.
Figure 3:
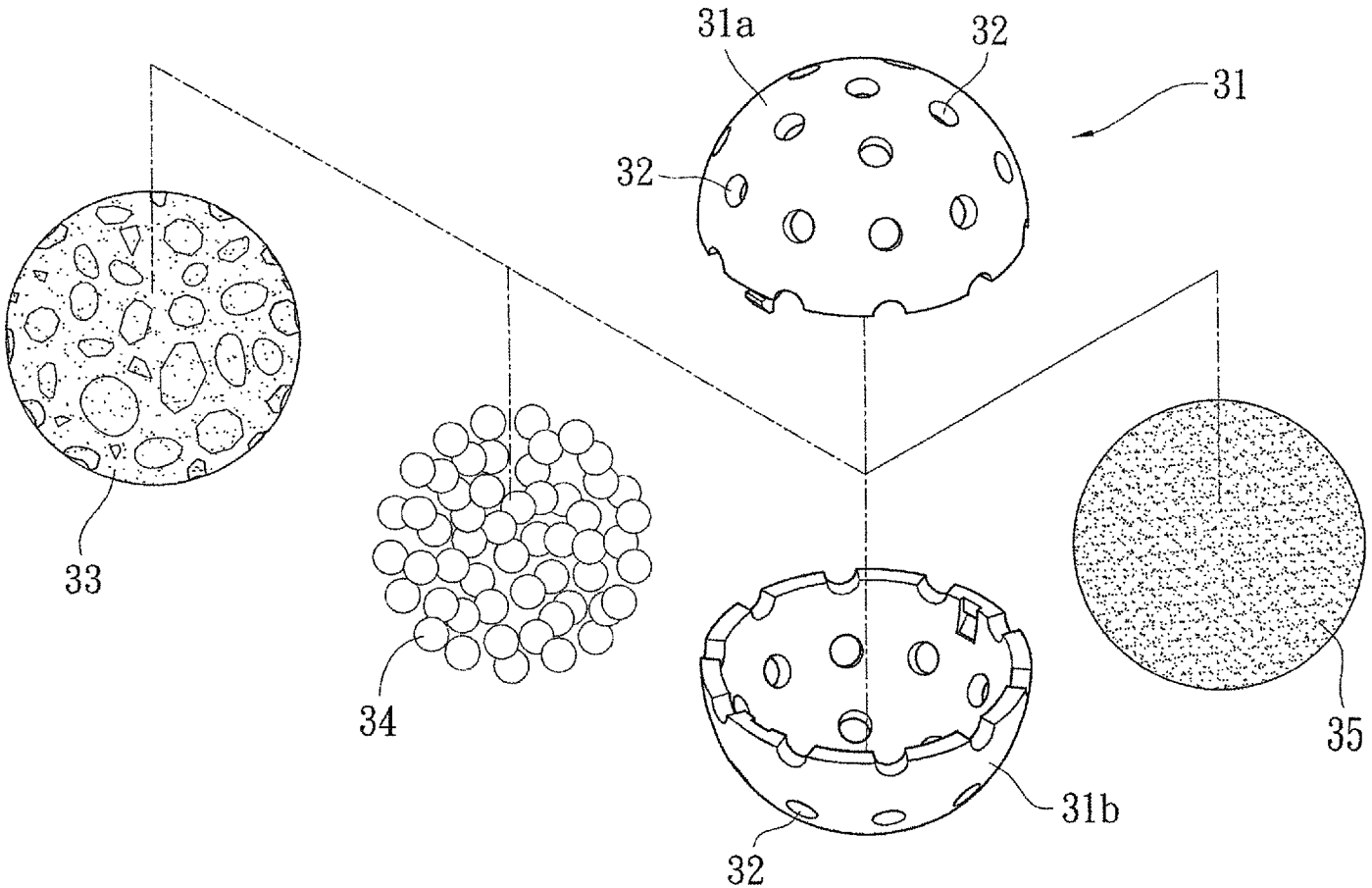
FIG. 3 is an exploded view showing various structures of hollow bodies that provide different functions according to the present invention.

Referring to FIGS. 2 and 3, the gradation layer according to the present invention comprises hollow bodies 31 of specific functions mixed in gradation materials commonly used for road construction or on-site earth. Each hollow body 31 comprises a shell that defines therein and delimits an interior space forming a receiving chamber and comprises a plurality of through apertures 32 formed therethrough to communicate with the receiving chamber.

The earth used in the gradation layer may comprise aggregates, soils, gravels, or a mixture of water permeable concrete, and additionally and selectively comprising other gradation materials that are of no harm to the environment. The hollow bodies 31 that show specific functions are preferably in the form of sphere, for a spherical structure is more resistant to compression stress from any direction and provides the greatest void volume in the gradation layer. However, the hollow body 31 may adopt other shapes.

According to an embodiment of the present invention, a gradation material is mixed with the hollow bodies 31 to form a mixed gradation material that will be later used to make the gradation layer 30. Separately, a fixed surface is prepared, such as underground soil stratum 20 that could be properly prepared, such as leveling, if necessary, and the mixed gradation material is laid atop the fixed surface so that the gradation layer 30 is formed of the mixed gradation material that contains the hollow bodies 31 mixed therein in such way as to be distributed in a generally uniform manner in the gradation material of the gradation layer 30, whereby in the gradation layer 30, the hollow bodies 31 are spaced from each other by a portion of the gradation material laid therebetween, as shown in FIGS. 1 and 2. This process makes a gradation with the mixed gradation material on the fixed surface. The portion of the gradation material that spaces two adjacent hollow bodies 31 from each other also isolate them from each other, making the hollow bodies independent of each other. Distributing the hollow bodies 31 in the gradation layer 30 in a mutually spaced manner helps prevent the existence of the hollow bodies 31 from affecting the strength or load carrying capacity of the soil or the gradation layer so that collapse of the soil or the gradation layer may not occur even though a heavy load, such as trucks or other heavy articles, is placed on or moves on the gradation layer 30. This arrangement also helps improve the ecological effect provided by the hollow bodies 31, which will be further discussed, at least for the reason that the hollow bodies 31 can be spread in a wide area.

Referring to FIG. 3, the hollow body 31 is composed of two halves, each constituting a shell member 31*a*, 31*b*, adhesively bonded together to form a hollow body, or fit to each other with stepped surfaces formed in jointing edges to form the hollow body, or combined to each other through buckling structures to form the hollow body, or alternatively an integrally formed unitary hollow body is made with blow molding or perfusion molding. Preferably, the hollow bodies are made of plastics, but they can be made of other traditionally used materials or recycled materials. The shell of the hollow body, which delimits the receiving chamber of the hollow body, is made of a wall of great thickness and the shell forms a plurality of through apertures 32 therein to communicate with the receiving chamber. The hollow bodies 31 used in the present invention can be made as engineering hollow body for different uses, such as a disaster-prevention water-storage hollow body, or an earth improvement hollow body, or a microorganism-culture hollow body or a water-keeping hollow body, or any type of hollow body that meet the need for on-site use.

The disaster-prevention water-storage hollow body is applied by mixing the hollow bodies 31 having shelling forming through apertures 32 in the gradation layer 30, whereby in case of extremely high precipitation falling on the ground surface, when the surface paving 60 conducts the rainwater downwards, the hollow interior space of the receiving chamber each of the hollow bodies 31 contained in the gradation layer 30 provides a space for collection of water by having water that is absorbed in the gradation layer 30 through the apertures 32 of the shells into the interior space of the hollow body, so that protection against risk of local flooding can be done in a short period. When surface water permeation is no longer in progress, with a sufficient time lapse, penetration gradually conducts the water into the underground soil stratum 20 and the underground water stratum 10. With the temporal storage of water in the disaster-prevention water-storage hollow bodies and then gradually released, the ground surface may acquire an effect of efficient water drain and replenishment of underground water resources in a short period.

The earth-improvement hollow body is constructed by depositing a carbon-contained substance 33, such as active carbon or binchotan, or an earth-improvement agent desired for improvement of local earth, in the interior space of the receiving chamber thereof. With the earth-improvement hollow bodies mixed in the gradation layer, the carbon-contained substance 33 functions to absorb and activate acidifying substance or harmful substance entraining water that penetrates downward and passes through the earth-improvement hollow bodies or that contained in the surrounding soil, so as to realize improvement of earth quality.

The microorganism-culture hollow body is constructed by depositing selected microbial strains 34 in the interior space of the receiving chamber thereof to serve as an excellent culture site for a large quantity of microorganisms. With the microorganism-culture hollow bodies mixed in the gradation layer, microorganisms can be effectively cultured and an improved environment for propagation is provided. The earth microorganisms so cultured can help decomposing organic substance contained in the soil, prompting nitrification, performing de-nitrification, and improving ecological environment of earth.

The water-keeping hollow body is constructed by filling a water absorption substance 35 in the interior space of the receiving chamber thereof, such as sponge or other water absorptive materials that are not decomposable by microorganisms, so that when the water-keeping hollow bodies are mixed in the gradation layer, the water absorption substance 35 helps to absorb water when water flows through the hollow bodies so as to keep water from flowing away from the earth that ensures sufficient supply of water for survival and propagation of microorganisms and also improving water preservation and increasing water content in dry area. In case of high temperature on the ground surface, the high content of water in the earth allows water to be converted into vapor that is then released to the environment for heat exchange with the environment so that the heat island effect can be eliminated or alleviated.

Figure 4:
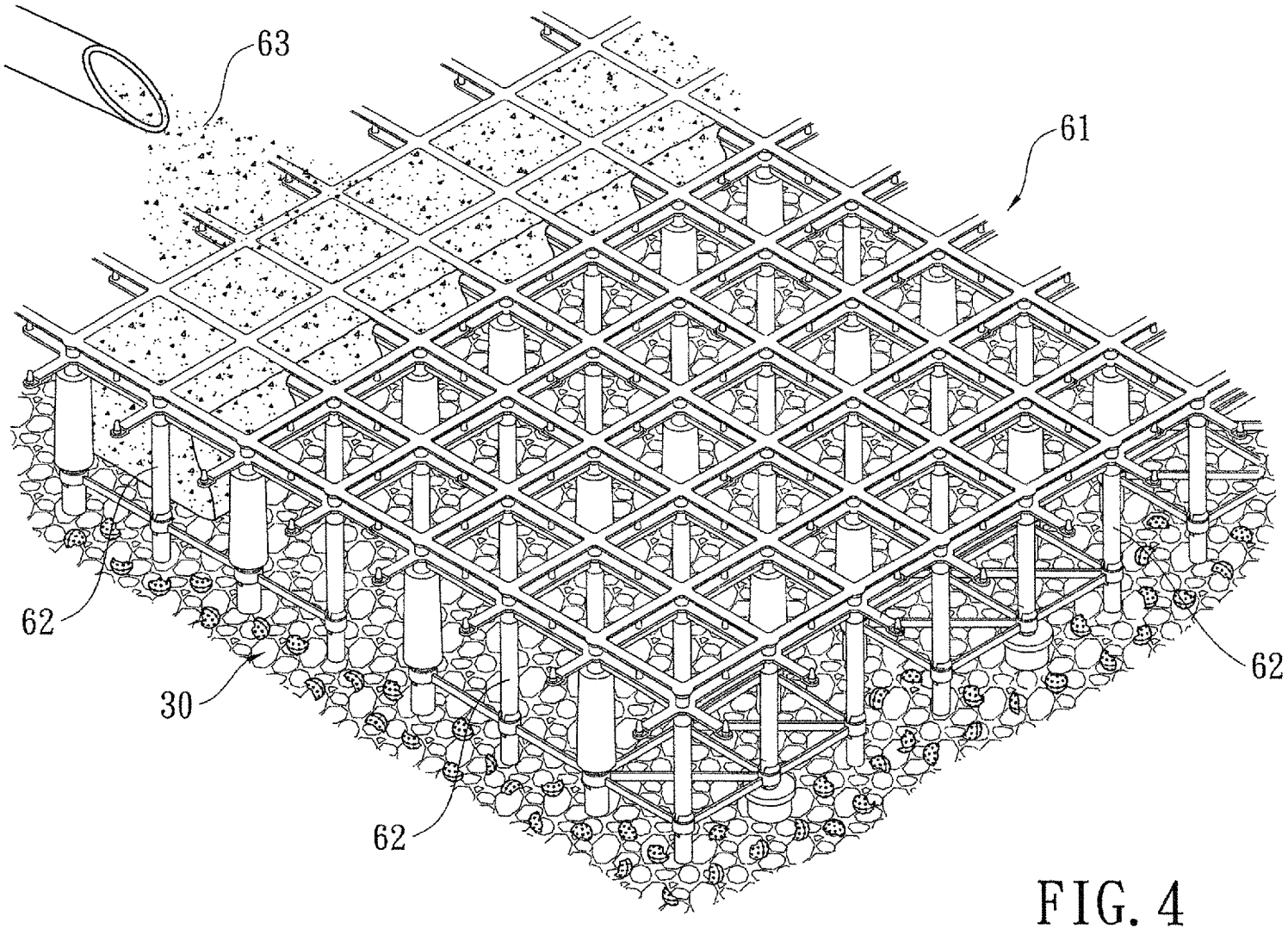
FIG. 4 is a schematic view showing forming water permeable surface paving on the gradation layer according to the present invention.
Figure 5:
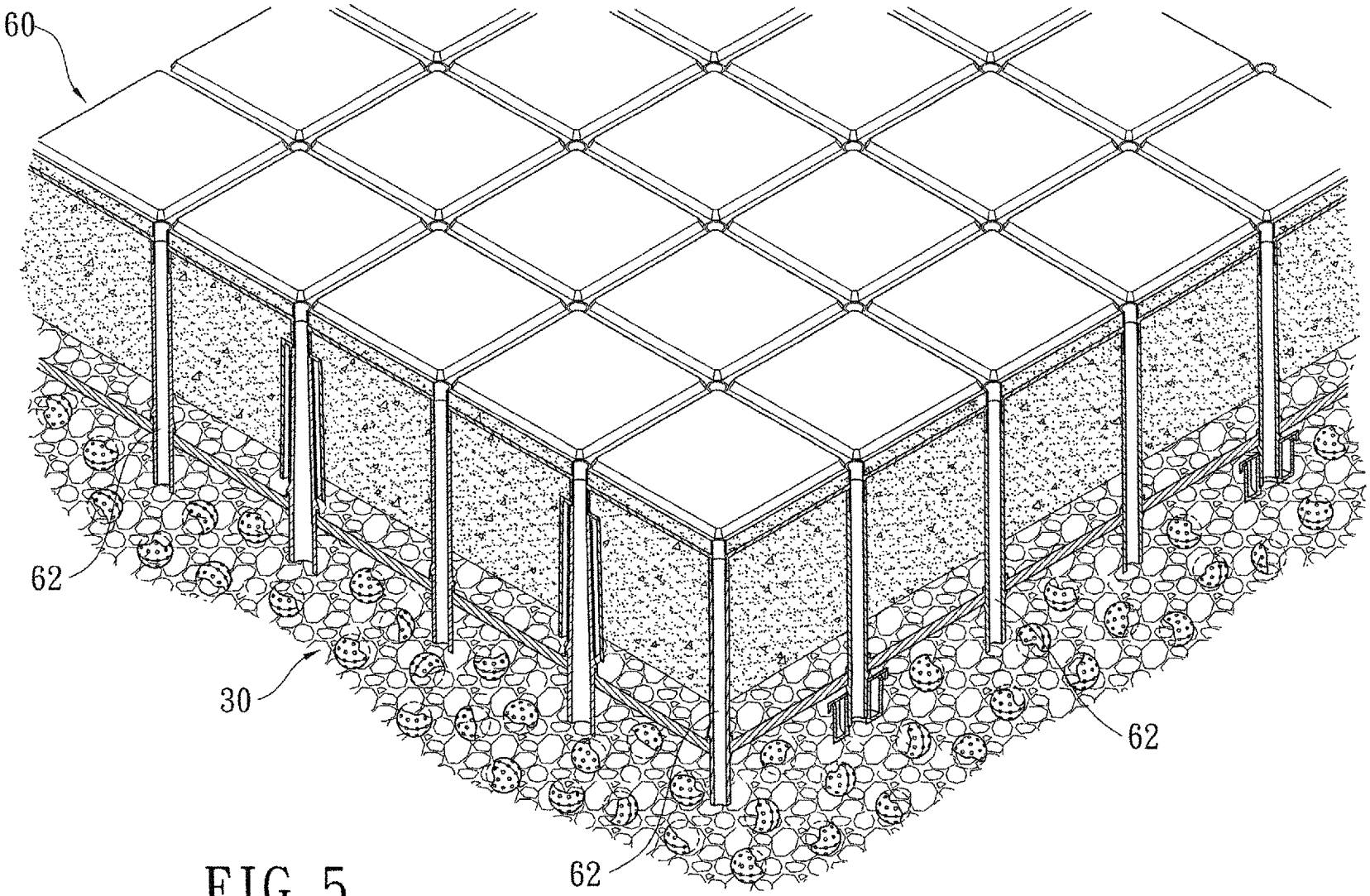
FIG. 5 is a schematic view showing complete formation of water permeable surface paving on the gradation layer according to the present invention.

Referring to FIGS. 4 and 5, a schematic view is shown to demonstrate that surface paving 60 is being formed on the gradation layer 30 after the gradation layer 30 according to the present invention has been completely laid. In the embodiment illustrated, the surface paving is water permeable paving, which comprises a framework 61 in which a plurality of drainpipes 62 is arranged. The framework 61 comprises plastic bars that connect the drainpipes. Cement grout 63 is then poured into the framework and is allowed to cure to form rigid concrete paving. Further, for paving 60 that is constructed in a water impermeable fashion, a top layer that is water permeable may be added thereon, in which water permeability being realized through for example paving that comprises water drain holes drilled therein by means of drilling tools, lawn, water permeable bricks, water permeable asphalt, and water permeable concrete. This provides the same result of being used in combination with the gradation layer 30 to construct a gradation layer featuring environmental protection and ecologic function, and thus providing the same effect of improving global warming.

Figure 6:
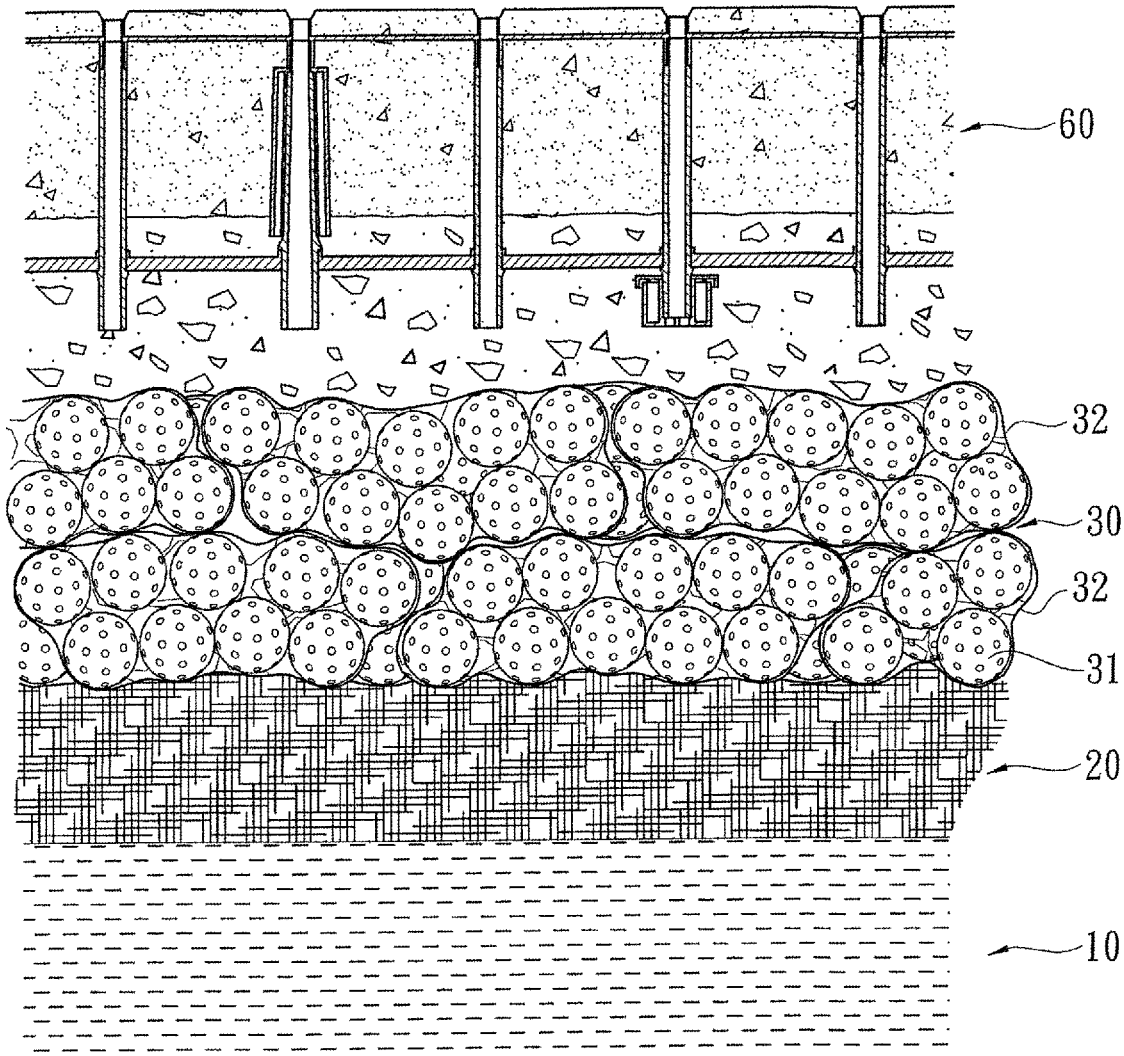
FIG. 6 is a schematic view showing a gradation layer according to the present invention containing therein hollow bodies that are accommodated in bags.

Referring to FIG. 6, in a different embodiment, the gradation layer 30 is formed of on-site earth or gradation material traditionally used for road construction, which is mixed with hollow bodies 31, which provide specific functions, according to the present invention. The hollow bodies 31 can be arranged in such a way that a plurality of hollow bodies are received and accommodated in a net bag to form a bag-contained hollow body unit 32. A plurality of bag-contained hollow body units 12 may be positioned together and mixed with on-site earth to make as a gradation layer. This also provides the same effects as discussed above.

In summary, the gradation layer according to the present invention is effective in collecting and storing rainwater that falls on and permeates downward through ground surface into the gradation layer, where the gradation layer, when being saturated with the rainwater, guides the rainwater through the apertures formed in shells of the hollow bodies into the bodies to be stored therein. As such, the water so stored can be supplied for survival of earth microorganisms and earth protozoa in time of earth being dried. Further, regulation of temperature and humidity through the underground water can be realized especially in a dried area to maintain living of plants and prevent desertification. In hot time, the wet earth can release vapor to the atmosphere for regulating the temperature of the atmosphere. As such, a method for manufacturing geological gradation featuring disaster prevention and ecologic function is provided.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

We claim:

1. A method for manufacturing geological gradation featuring disaster prevention and ecologic function, comprising the following steps:

preparing a fixed surface of soil, providing a gradation material for road construction, mixing hollow bodies in the gradation material to form a mixed gradation material, in which the hollow bodies are dispersedly distributed in the gradation material in a substantially uniformly scattered manner so as to be isolated from each other by a distance with a portion of the gradation material interposed therebetween, each of the hollow bodies having a shell delimiting an interior space that forms a receiving chamber, through apertures defined in the shell and in communication with the receiving chamber, the receiving chamber of each of the hollow bodies receiving therein a carbon-contained substance or an earth-improvement agent so that the hollow body serves as an earth-improvement hollow body, and laying the gradation material atop the prepared fixed surface to form a gradation that contains the hollow bodies uniformly distributed therein.

2. The method according to claim 1, wherein the shell of each of the hollow bodies that comprises the through apertures formed therein is composed of two halved shell members that mate each other.

3. The method according to claim 1, wherein the shell of each of the hollow bodies that comprises the through apertures formed therein is integrally formed as a unitary body through blow molding.

4. The method according to claim 1, wherein the shell of each of the hollow bodies that comprises the through apertures formed therein is integrally formed as a unitary body through perfusion molding.

5. A method for manufacturing geological gradation featuring disaster prevention and ecologic function, comprising the following steps:

preparing a fixed surface of soil, providing a gradation material for road construction, mixing hollow bodies in the gradation material to form a mixed gradation material, in which the hollow bodies are dispersedly distributed in the gradation material in a substantially uniformly scattered manner so as to be isolated from each other by a distance with a portion of the gradation material interposed therebetween, each of the hollow bodies having a shell delimiting an interior space that forms a receiving chamber, through apertures defined in the shell and in communication with the receiving chamber, the receiving chamber of each of the hollow bodies receiving therein microbial strains so that the hollow body serves as a microorganism-culture hollow body, and laying the gradation material atop the prepared fixed surface to form a gradation that contains the hollow bodies uniformly distributed therein.

6. The method according to claim 5, wherein the shell of each of the hollow bodies that comprises the through apertures formed therein is composed of two halved shell members that mate each other.

7. The method according to claim 5, wherein the shell of each of the hollow bodies that comprises the through apertures formed therein is integrally formed as a unitary body through blow molding.

8. The method according to claim 5, wherein the shell of each of the hollow bodies that comprises the through apertures formed therein is integrally formed as a unitary body through perfusion molding.

9. A method for manufacturing geological gradation featuring disaster prevention and ecologic function, comprising the following steps:

preparing a fixed surface of soil, providing a gradation material for road construction, mixing hollow bodies in the gradation material to form a mixed gradation material, in which the hollow bodies are dispersedly distributed in the gradation material in a substantially uniformly scattered manner so as to be isolated from each other by a distance with a portion of the gradation material interposed therebetween, each of the hollow bodies having a shell delimiting an interior space that forms a receiving chamber, through apertures defined in the shell and in communication with the receiving chamber, the receiving chamber of each of the hollow bodies receiving therein a water absorptive material so that the hollow body serves as a water keeping hollow body, and laying the gradation material atop the prepared fixed surface to form a gradation that contains the hollow bodies uniformly distributed therein.

10. The method according to claim 9, wherein the shell of each of the hollow bodies that comprises the through apertures formed therein is composed of two halved shell members that mate each other.

11. The method according to claim 9, wherein the shell of each of the hollow bodies that comprises the through apertures formed therein is integrally formed as a unitary body through blow molding.

12. The method according to claim 9, wherein the shell of each of the hollow bodies that comprises the through apertures formed therein is integrally formed as a unitary body through perfusion molding.

13. The method according to claim 9, wherein the water absorptive material comprises sponge.

* * * * *